US008984762B2

(12) United States Patent
Trojosky et al.

(10) Patent No.: US 8,984,762 B2
(45) Date of Patent: Mar. 24, 2015

(54) DRYER FOR TREATING GARDEN WASTE

(75) Inventors: Mathias Trojosky, Kirchheim unter Teck (DE); Hermann Weiss, Hochdorf (DE)

(73) Assignee: Allgaier Werke GmbH, Ubingen (DE)

( * ) Notice: Subject to any disclaimer, the term of this patent is extended or adjusted under 35 U.S.C. 154(b) by 262 days.

(21) Appl. No.: 12/998,487

(22) PCT Filed: Feb. 18, 2010

(86) PCT No.: PCT/EP2010/001009
§ 371 (c)(1),
(2), (4) Date: Jul. 8, 2011

(87) PCT Pub. No.: WO2010/094476
PCT Pub. Date: Aug. 26, 2010

(65) Prior Publication Data

US 2011/0258873 A1 Oct. 27, 2011

(30) Foreign Application Priority Data

Feb. 23, 2009 (DE) ..... 10 2009 010 003
Oct. 30, 2009 (DE) ..... 10 2009 051 381

(51) Int. Cl.
*F26B 19/00* (2006.01)
*F26B 17/20* (2006.01)
*F26B 25/04* (2006.01)

(52) U.S. Cl.
CPC ..... *F26B 17/20* (2013.01); *F26B 25/04* (2013.01)
USPC ..... 34/236; 34/166; 34/179; 34/182

(58) Field of Classification Search
CPC ..... F26B 3/20; F26B 13/105; F26B 17/04; F26B 15/122; F26B 15/143; F26B 21/004; F26B 25/001; F26B 15/18; F26B 21/14; F26B 2200/18; F26B 17/20; F26B 25/04; F26B 3/0923; F26B 3/00; F26B 17/107; A21C 9/00; B04B 11/02
USPC ..... 34/236, 166, 179, 185, 315, 593, 312, 34/320, 321, 318, 359, 360, 368, 576, 582, 34/586, 181, 182; 432/15, 58
See application file for complete search history.

(56) References Cited

U.S. PATENT DOCUMENTS 1,213,962 A * 1/1917 Siler ..... 34/233
6,189,234 B1 * 2/2001 Luker ..... 34/166

FOREIGN PATENT DOCUMENTS

| | | |
|---|---|---|
| DE | 29 24 523 | 1/1981 |
| DE | 699 12 393 | 5/2004 |
| EP | 1 319 632 | 6/2003 |
| GB | 843705 | 8/1960 |

* cited by examiner

*Primary Examiner* — Kenneth Rinehart
*Assistant Examiner* — Bao D Nguyen
(74) *Attorney, Agent, or Firm* — Farjami & Farjami LLP

(57) ABSTRACT

The invention relates to a dryer for drying of garden waste, particularly of chopped lop and other bulk material, comprising an elongated lying container with a cross section which is at least partially round;

the container comprises at its one end an inlet and at its other end an outlet for the material;

the container wall is perforated at least over parts of its length;

the perforations are connected to pressurized air;

there are provided conveyer means which seize the material in the ascending quadrant of the container wall and transport the same upwardly over a certain length of path.

3 Claims, 5 Drawing Sheets

DRYER FOR TREATING GARDEN WASTE

This is a U.S. national phase application which is based on, and claims priority from, PCT application Ser. No. PCT/EP2010/001009, filed Feb. 18, 2010, which claims priority from two foreign applications: Ser. No. 102009010003.2 filed Feb. 23, 2009 in Germany; and Ser. No. 102009051381.7 filed Oct. 30, 2009 in Germany.

The invention relates to a dryer for the treatment of garden waste, so called lop, as well as further bulk material, e.g. chips.

A great number of dryers have become known for drying of any kind.

E.g. dryers have become known, comprising a container with a double bottom. Thereby, a first bottom is arranged above the other one. The upper bottom is perforated. Drying air is fed through the perforations into the space above the first bottom. A disadvantage consists in the fact that drying is not effected uniformly so that there is a humidity gradient in the material.

Further, there are belt dryers. Thereby, material to be dried is deposited on a conveyer belt, and air is blown onto it, e.g. coming from above or from below. Again a material is produced the humidity of which is different at different locations so that there is a humidity gradient. Also, the dimensions of such belt dryers are very large. Particularly with chips of wood the belt is not covered uniformly.

Drying towers have become known, comprising a tower shaped container. The material is fed to the container from above, and removed from below. Thereby, the stream of drying air is not always uniform. Also, there is the risk of clogging.

With drum dryers the material is fed into the drum at one side, and removed at another one. Also, air is blown into the dryer. The air transports the light wood particle toward the exit so that the dwell times become short, or complicated inserts are necessary which jeopardize maintenance, and tend to clogging. A further disadvantage consists in that the dwell times during drying are different from particle to particle. The drum dryer does not operate economically at lower temperatures. Therefore, it has to be very large.

Further, fluidized bed dryers have become known, whereby a fluidized bed is formed by the material to be dried. In case of a material the particles of which have a certain weight, or have the tendency to intermingle, such as wood chips, there is no perfect mixing. Therefore, drying is not uniform.

The material mentioned above, e.g. garden waste etc., is particularly problematic. This is particularly true if the material comprises fibrous or thread like particles having a tendency to spinning. Thereby, balls are formed which form clusters. The inner area of such clusters is not sufficiently dried, but remains humid.

It is the objective of the invention to provide a dryer which is simple in design, produce uniform drying, allows for long dwell times at low volumes, and may be manufactured a low costs. The dryer should be particularly suitable for drying of the material as mentioned above.

The said objective is solved by the features of claim 1.

Accordingly, a dryer according to the invention comprises the following features:

- an elongated, lying container having a bottom with a round section;
- at one end of the container there is an inlet, and at the other end an outlet for the material;
- the container wall is perforated at least at a portion of its length;

- the perforations are connected to pressurized air which enters through the container wall the interior of the container;
- there are conveyer means provided, grasping the material in the ascending quadrant of the container wall, and conveying the same along the container wall over a certain distance upwardly.

The container may have the form of a shell or a tub open at its upper end. It may be closed, such as a cylinder. It may have a circular cross section or an elliptical cross section, or any other cross section. It is important that the bottom area is at least partially round.

The inventors have perceived the following:

In case further conveying means are used, located in the container and rotating the material on its way from inlet to outlet of the container, there is the risk of compression of the material. Such compressing is extremely disadvantageous. There is the risk of locking of the conveyer means, i.e. of a rotating stirrer. Further, the material is not distributed uniformly, because forming of the said clusters is enhanced. There remains humidity inside of each cluster. Therefore, the drying is not uniform. This is particularly the case if a stirrer is used, comprising a stirrer shaft which is arranged parallel to the conveyer path inside the container, further stirrer arms which when rotating in the descending quadrant of the container wall exert pressure onto the material, thereby compressing the same.

If, however, instead the material is guided along the container wall over a certain distance in the ascending quadrant of the container wall upwardly, it will tip over to the centre of the container. Thereby, a rotating movement of the material is achieved. The material conducts two movements: First, a travelling movement from inlet to outlet of the container, and second the said rotating movement. Compression of the material is avoided.

Various conveying elements may be considered. See the description of the figures.

It is advantageous to locate pressurized air used for drying and loosening in the ascending quadrant of the container wall. This may enhance the rotary movement of the material.

Also, a plurality of pressurized air jets may serve as conveying means so that no (mechanical) conveying means are necessary.

Instead of the said conveying means located in the ascending quadrant, or in addition to those, also the following solution may be considered: Pressurized air is fed primarily or alone in the ascending quadrant of the container wall. A stirrer may be provided. The same should preferably comprise stirrer arms, which are curved so that the same in a certain sense envelope put the material into rotation. Thereby the mass of material is located in the ascending quadrant of the container wall.

The invention is explained by the drawing, showing the following in greater detail:

Figure 2:
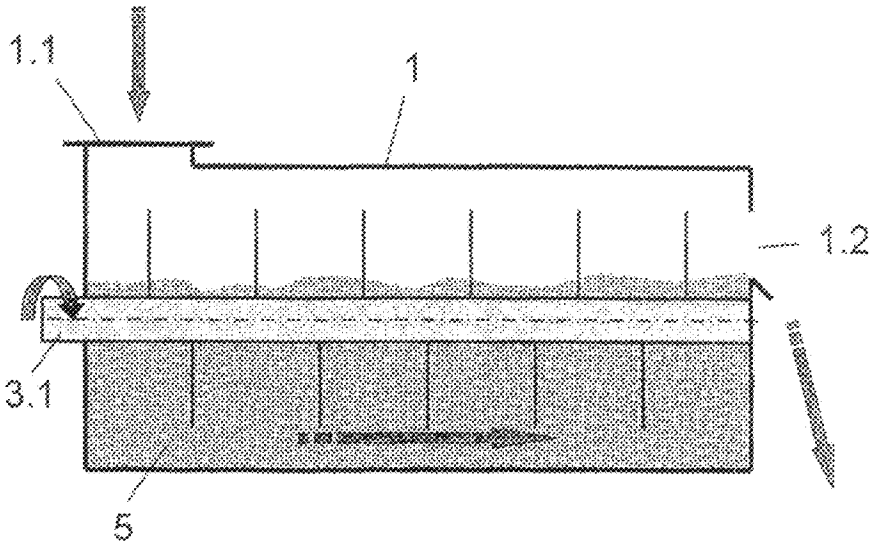
FIG. 2 shows the first embodiment in a longitudinal section.
Figure 1:
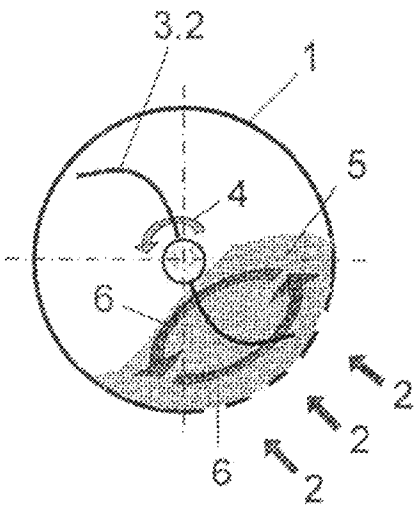
FIG. 1 shows a first embodiment in a cross section.

The first embodiment as shown in FIGS. 1 and 2 comprises a container with a round cross section. Container 1 essentially is a cylinder. It comprises an inlet 1.1 and an outlet 1.2 for the material to be dried.

FIG. 1 shows a plurality of perforations 1.3 in the container wall. The perforations may be of any shape, e.g. bores or slots. They serve for introducing of pressurized air from outside into the interior of the container. See the arrows 2.

The container comprises a stirrer 3, with a stirrer shaft 3.1 and stirrer arms 3.2. As may be seen from FIG. 1, the stirrer arms 3.2 are curved. The curvature is convex, as seen in the sense of rotation. See arrow 4, showing the direction of rotation of stirrer 3.

The curvature of the stirrer arms 3.2 serve the following purpose: The pressure which any stirrer arm during rotation exerts onto the material, is minimized, and therewith also blocking up and forming of clusters of the material.

Figure 3:
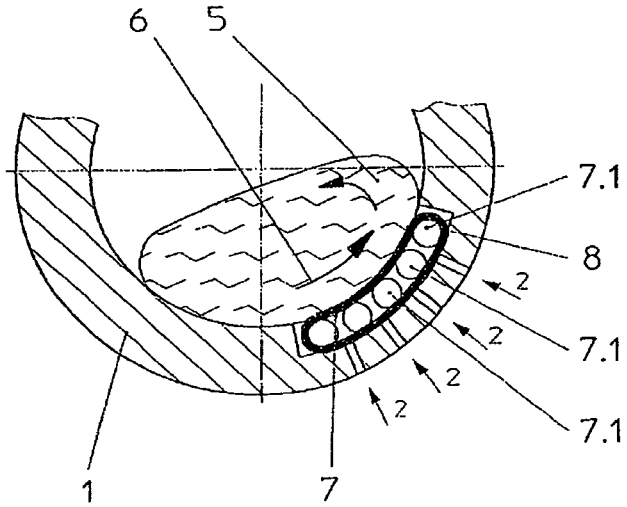
FIG. 3 shows schematically in a cross section the container wall of a second embodiment.

The material 5 is collected in the region of the ascending quadrant of the container wall. It follows a rotational movement. See both arrows 6. The ascending quadrant acts as kind of a rotating bed. The embodiment shown in FIG. 3 comprises as conveying element a rotating belt 7, carried by rolls 7.1. The first and the last role—as seen in the direction of rotation—are driven, so that the belt rotates in a sense that causes a rotational movement of the material in the direction of the arrows 6. Here again see the pressurized air jets 2 going through nozzle plate 8. Belt 7 consists of a wire web, or also has perforations so that pressurized air 2 may penetrate through belt 7 and arrive at material 5.

Figure 4:
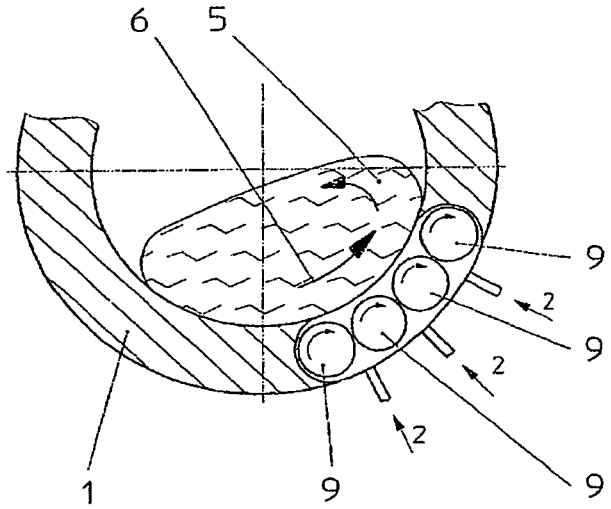
FIG. 4 shows schematically in a cross section the container wall of a third embodiment.

With the third embodiment shown in FIG. 4 there are several rolls 9 embedded in the container wall. Rolls 9 are driven in order to transmit a rotational movement onto material 5. Pressurized air 2 is guided through the intervals between neighboured rolls 9. The outer surfaces of the rolls 9 directly engage the material 5. The outer surfaces may comprise grasping means.

Figure 5:
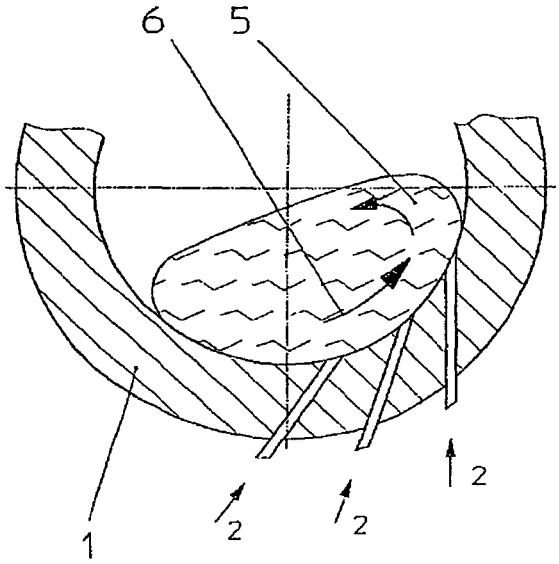
FIG. 5 shows schematically in a cross section the container wall of a fourth embodiment.

Of particular importance is the fourth embodiment as per FIG. 5. Thereby, pressurized air nozzles are inserted into the container wall at such an angle that the pressurized air puts the material into a rotational movement.

In general, the pressurized air with all embodiments preferably is fed to the ascending quadrant of the container wall. It may, however, outside of the said quadrant be fed through additional perforations.

Figure 6:
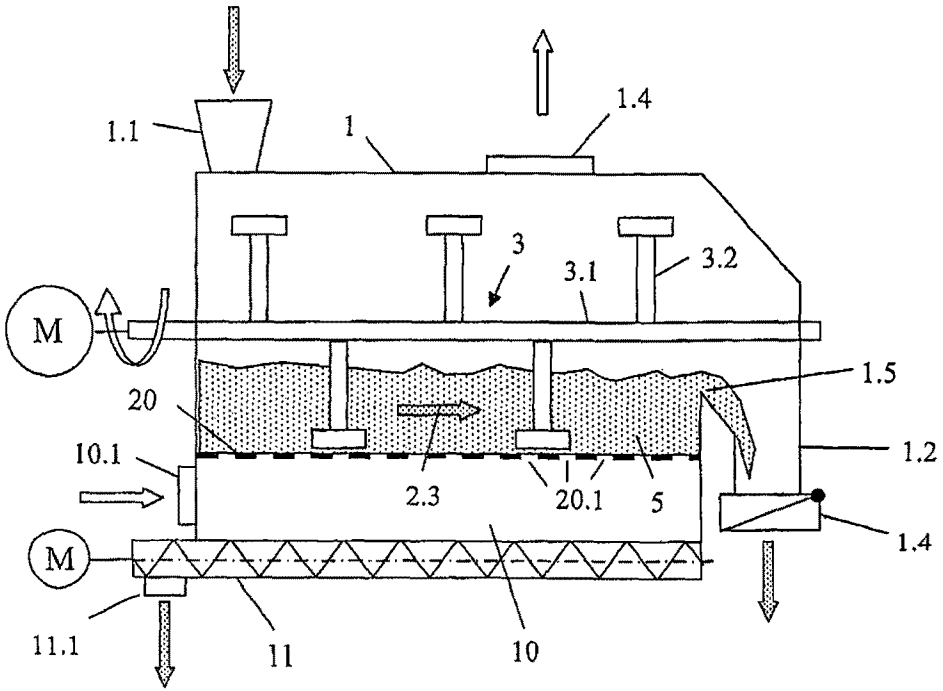
FIG. 6 shows a fifth embodiment in a longitudinal section.

The dryer according to the fifth embodiment as per FIG. 6 comprises a first container. This is again a lying, elongated cylinder. At the end of outlet 1.2 there is a valve 1.4. In the first container 1 there is again a stirrer 3, analogous to the stirrer according to FIGS. 1 and 2.

Below the first container 1 there is a second container 10. It is approximately as long as the first container, in the present case somewhat shorter. The second container 10 also comprises one or several connections 10.1 as air inlets.

Between the two containers 1 and 10 there is an intermediate wall 20. Intermediate wall 20 is common to both containers 1 and 10, thereby separating the same. Intermediate wall 20 comprises a plurality of perforations 20.1.

The second container 10 is of conical cross section. It is provided with removal means. Inside the second container 10 there are conveying means as removing means, such as a screw conveyer 11. At the end of screw conveyer there is an outlet 11.1.

The dryer according to FIG. 6 performs as follows: The material to be dried is fed to container 1 through inlet 1.1. The material again may be any pourable material such as crumbly matter, grain, biomass, plastic granulate, chips, fibrous material.

During operation of container 1 the material 5 will adopt a certain level.

With this as well as with all other embodiments the speed of the stirrer 3 is adjustable. Also an intermitting mode of operation may be considered.

The first container at its downward end comprises an overflow weir 1.5.

The following features respectively steps may be advantageous with all embodiments:

- there is a separate air heater in advance of the container 1;
- container 1, and where applicable, also container 10—are lying;
- the arrangement may be horizontal, but also angles of 5, 10, 15, 20, 25, 30 . . . 45 degree may be considered;
- one or both containers may be divided into sections regarding the guidance of air, in order to enhance the drying process over the conveying path;
- the cross section of each container may change over its length. It may become shorter or longer.

Figure 7:
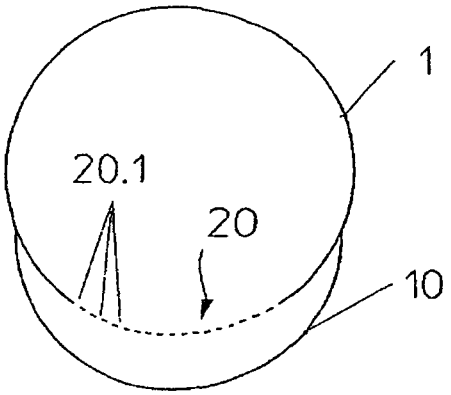
FIG. 7, 8, 9 show schematically cross sections of variants of the fifth embodiment.
Figure 8:
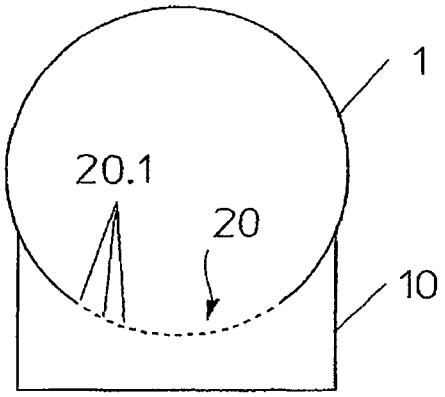
Figure 9:
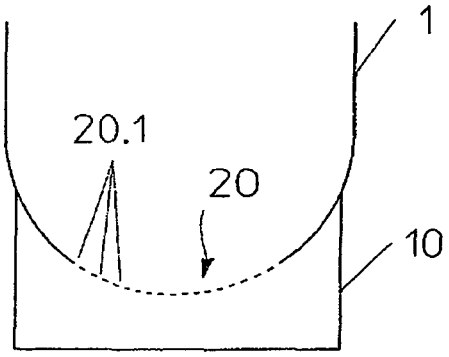

FIGS. 7, 8 and 9 show variants of the second container 10.

The dryer according to the fifth embodiment may perform the following operations—see particularly the embodiment according to FIG. 6:

- it dries the material;
- it removes light weight particles such as dust, together with the upwardly moving air;
- it removes heavy impurities such as sand, soil, through the perforated wall between the two chambers and through the outlet.

The treated material is dry and free of undesired components. It may be processed to pellets or briquettes. It may be burned directly. Also the use with pyrolysis processes may be considered.

Invention may be summarized as follows:

- the dried material is transported mechanically, and perfectly mixed;
- the dried material has a uniform residual humidity, not only over a period of time, but also from particle to particle;
- also big lumps of bulk material may be transported free of jamming;
- the function of mechanical transportation of the material on the one hand as well as the thermodynamic drying on the other hand are separated, i.e. performed by different means which makes processing easier;
- the dwell time of the material in the drying area may be selected freely so that long as well as short dwell times may be adjusted;
- the temperature of the drying process is freely selectable; the concept is adopted particularly to the use of residual energy with low temperature levels;
- the product forms an aerated stationary bed in the upper chamber, offering optimum conditions for a perfect transmission of heat;
- the unit has relatively small dimensions;
- in addition to the mixing means there are no inserts in the upper chamber 1, so that no clogging may occur;
- the dryer according to the invention also may be used for cooling of material;
- chamber 3 may be conical, thereby tapering or enlarging in the direction of travel;
- the energy consumption for the pressurized air is low.

LIST OF REFERENCE SIGNS

1 container
1.1 inlet for the material to be dried
1.2 outlet for the dried material

1.3 perforations
1.4 valve
1.5 overflow weir
2 pressurized air
3 stirrer
3.1 stirrer shaft
3.2 stirrer arms
5 material
7 endless belt
7.1 rolls
8 nozzle plate
9 rolls
10 second container
10.1 connection
11 screw conveyer
11.1 outlet
20 intermediate wall
20.1 perforations

The invention claimed is:

1. A dryer for drying of garden waste, the dryer comprising:

an elongated lying container comprising an inlet at a first end and an outlet at a second end, wherein a bottom of the elongated lying container includes a partially round cross section and a plurality of perforations connected to pressurized air, the plurality of perforations are located only on an ascending quadrant of a container wall of the elongated lying container in order to feed pressurized air into an interior of the elongated lying container;

a conveyer that seizes material in the ascending quadrant of the container wall, and transports the material along the container wall over a certain length of path upwardly;

the conveyer comprises a conveyer shaft and conveyer arms, the conveyer arms envelope the material and convey the material over the ascending quadrant of the bottom upwardly so that the material performs a rotary movement and tips over to a center of the elongated lying container, wherein the material is collected only in a part of a cross section of the elongated lying container, wherein the conveyer arms are forwardly curved and are perpendicular to the conveyer shaft.

2. The dryer according to claim 1, wherein the conveyer arms have a shape of curved shovels.

3. The dryer according to claim 1, wherein the part of the cross section is a lower right quadrant of the elongated lying container.

* * * * *